US005525245A

United States Patent [19]

Grandmaire et al.

[11] Patent Number: 5,525,245

[45] Date of Patent: Jun. 11, 1996

[54] CLEAR, CONCENTRATED LIQUID FABRIC SOFTENER COMPOSITIONS

[75] Inventors: Jean-Paul Grandmaire, Andrimont; Anita Hermosilla, Othee, both of Belgium

[73] Assignee: Colgate-Palmolive Company, New York, N.Y.

[21] Appl. No.: 361,350

[22] Filed: Dec. 21, 1994

[51] Int. Cl.[6] ..... D06M 13/46; D06M 13/10

[52] U.S. Cl. ..... 252/8.8; 252/8.6; 252/8.75; 252/8.9

[58] Field of Search ..... 252/8.6, 8.75, 252/8.8, 8.9

[56] References Cited

U.S. PATENT DOCUMENTS

| | | | |
|---|---|---|---|
| 3,892,669 | 7/1975 | Rapisarda et al. | 252/8.75 |
| 4,149,978 | 4/1979 | Goffinet | 252/8.8 |
| 4,351,737 | 9/1982 | Billenstein et al. | 252/8.8 |
| 4,439,335 | 3/1984 | Burns | 252/8.75 |
| 4,447,343 | 5/1984 | May et al. | 252/8.75 |
| 4,569,800 | 2/1986 | Stanley et al. | 260/501.15 |
| 4,675,118 | 6/1987 | Stanley et al. | 252/8.8 |
| 4,751,009 | 6/1988 | Damaso et al. | 252/8.75 |
| 5,066,414 | 11/1991 | Chang | 252/8.8 |
| 5,133,885 | 7/1992 | Contor et al. | 252/8.6 |
| 5,399,272 | 3/1995 | Swartley et al. | 252/8.8 |
| 5,409,621 | 4/1995 | Ellis et al. | 252/8.8 |

FOREIGN PATENT DOCUMENTS

94/04643 3/1994 WIPO .

*Primary Examiner*—Anthony Green
*Attorney, Agent, or Firm*—Bernard Lieberman; James M. Serafino

[57] ABSTRACT

Clear fabric softener microemulsion compositions have been developed for use in the rinse cycle comprising a combination of diester quaternary ammonium surfactants, diamido ammonium surfactants and selected organic solvents. Fatty co-softeners and oil perfumes may be included as optional ingredients. These microemulsions are converted to macroemulsions upon dilution with water in the rinse cycle to provide a fabric softening treatment.

26 Claims, No Drawings

CLEAR, CONCENTRATED LIQUID FABRIC SOFTENER COMPOSITIONS

BACKGROUND OF THE INVENTION

1. Field of the Invention

This invention relates to rinse cycle fabric softener compositions. More particularly it relates to aqueous liquid microemulsion fabric softener compositions that are clear, i.e., transparent even when highly concentrated.

2. Description of Related Art

U.S. Pat. No. 3,892,669 issued to A. A. Rapisarda et al. relates to a clear aqueous fabric softening composition containing a solubilized tetra alkyl quaternary ammonium salt having two short-chain alkyl and two long-chain alkyl groups, about 5% to about 25% of the latter having methyl and ethyl branching on the 2-carbon atom. Solubilization is effected by the presence of solubilizers comprising aryl sulfonates, diols, ethers, low molecular weight quaternaries, sulfobetaines, taurines, sulfoxides and non-ionic surfactants.

U.S. Pat. No. 4,149,978 issued to P. C. E Goffinet describes textile treatment compositions comprising a water-soluble fabric softener and a C12–C40 hydrocarbon optionally together with a water-soluble cationic surfactant. The preferred fabric softeners are quaternary ammonium salts having two C10–C22 alkyl chains.

U.S. Pat. No. 4,351,737 issued to S. Billenstein describes and claims softening concentrates containing 30–70% of a cationic softener, 5–50% of a non-ionic softener, 5–20% of a non-ionic dispersing agent, 5–30% of a C1 to C3 alkanol, 5–30% of liquid glycol, polyglycol or alkyl ether and water and optionally perfume and dyestuffs.

The fabric softener prepared according to this patent is alleged to be easily dispersible in water.

U.S. Pat. No. 4,569,800 issued to K. D. Stanley et al. teaches the use of hydrogenated tallowalkyl 2-ethylhexyl dimethylammonium salts dissolved in water and/or ethanol or in isopropanol in fabric softener compositions. These compositions are clear because they form true solutions.

While consumer preference favors clarity in fabric softener compositions, fabric softeners are preferably brought into contact with the fabric as macroemulsions.

It is an object of this invention to provide a clear liquid fabric softener composition that is environmentally acceptable.

It is another object to provide such a fabric softener composition as an aqueous microemulsion concentrate.

It is also an object that this microemulsion composition be physically stable for at least about six weeks.

Another object is to provide a microemulsion which upon dilution, as in a washing machine dispenser, forms a macroemulsion without gelification.

Other objects will become apparent to those skilled in the art upon a further reading of the specification.

SUMMARY OF THE INVENTION

The objects cited above have been satisfied by a clear fabric softener composition comprising an aqueous microemulsion concentrate of:

(A) a diester quaternary ammonium surfactant fabric softener having the formula:

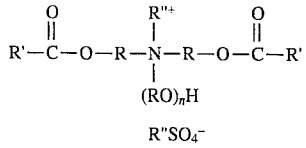

(1)

wherein R is an alkylene radical having 2 to about 4 carbon atoms,

R' is an alkyl or alkenyl group having 8 to about 22 carbon atoms, n is an integer having values of 1 to about 4, and R" is a lower alkyl radical having 1 to about 4 carbon atoms, and/or a diamido ammonium surfactant fabric softener having the formula

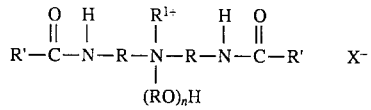

(2)

wherein n, R and R' are as defined above, $R^{1+}$ is a lower alkyl radical having 1 to about 4 carbon atoms or hydrogen and X is $R''SO_4^-$, $Br^-$ or $Cl^-$ wherein R" is a lower alkyl radical having 1 to about 4 carbon atoms, (B) an organic solvent, (C) an optional water-immiscible oil perfume, and (D) an optional fabric co-softener selected from the group consisting of fatty alcohols, fatty acids, fatty esters, fatty amines or amine/amides, whereby said microemulsion is convertible to a milky macroemulsion upon dilution with water.

All of the ingredients of the composition delineated above, both required and optional, must be normally liquid, i.e., liquid at ambient room temperatures.

The preferred concentration of softeners in these microemulsions lies between about 40% and about 60% although as little as 10% can be used.

The microemulsion compositions of this invention can contain about 10% to about 60% of the primary softeners, diester quaternary ammonium surfactants and diamido ammonium surfactants, about 5% to about 40% of organic solvent, from 0 to about 15% of co-softener and 0 to about 10% of oil perfume, and the remainder water all on a 100% weight basis.

Most of the prior art quaternary ammonium compounds, commonly designated as Quats, are not environmentally friendly because of their toxicity to aquatic life and/or their poor biodegradability. However the softeners of this invention, both the dioleyl diester Quats and the diamido ammonium compounds are environmentally friendly.

Diester quaternary ammonium surfactant fabric softeners, represented by equation (1) are commercially available from Stepan Co. as Stepantex and from KAO Corp. as Tetranyl but can also be synthesized by the reaction of two moles of a fatty acid with a trialkanolamine followed by alkoxylation and methylation with dimethyl sulfate or an alkyl halide such as, methyl iodide. In a preferred mode the fatty acid is oleic acid and ethylene oxide is used as the alkoxylation agent. For economical reasons it has been found that Soya fatty acids are a practical source for this purpose consisting of about 3% myristic acid, about 5% palmitic acid, about 5% palmitoleic acid, 1.5% stearic acid, 72.5% oleic acid and about 13% linoleic acid. Other sources of useful fatty acids are those obtained from the saponification of beef tallow, butter, corn oil, cottonseed oil, lard, olive oil, palm oil, peanut oil, cod liver oil, coconut oil and the like.

A preferred diester quaternary ammonium surfactant fabric softener is methyl bis[ethyl(oleyl)]-2-hydroxyethyl ammonium methyl sulfate. Other diesters useful in the practice of this invention include:

methyl bis-[ethyl(coconut)]-2-hydroxyethyl ammonium methyl sulfate methyl bis-[ethyl(decyl)]-2-hydroxyethyl ammonium methyl sulfate methyl bis-[ethyl(dodeceyl)]-2-hydroxyethyl ammonium methyl sulfate methyl bis-[ethyl(lauryl)]-2-hydroxyethyl ammonium methyl sulfate methyl bis-[ethyl(palmityl)]-2-hydroxyethyl ammonium methyl sulfate methyl bis-[ethyl(soft-tallow)]-2-hydroxyethyl ammonium methyl sulfate, and the like.

The designation of the terms coconut and soft-tallow indicate mixtures of esters corresponding to the fatty acid source.

In the preparation of the diester quaternary ammonium surfactants, a certain amount of the triester homolog may be produced as an impurity. Unlike the diester, it is not soluble in water and has to be considered as an oil to be emulsified.

A preferred diamido ammonium surfactant fabric softener is the methyl bis-(oleyl amido ethyl)-2-hydroxyethyl ammonium methyl sulfate, a quaternary. This can be synthesized by the interaction of one mole of triethylamine with two moles of oleic acid followed by ethoxylation with ethylene oxide and methylation with dimethyl sulfate. As in the case of the preparation of the diester compounds above, either pure fatty acids or mixtures obtained from the saponification of natural fats and oils can be utilized in their synthesis. These diamido quaternary ammonium surfactant fabric softeners are also commercially available from Rewo as Rewopo P.

Another preferred diamido ammonium surfactant fabric softener is the diOleyl diamido amine having the structure:

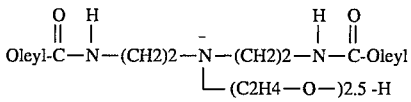

The term "perfume" is used in its ordinary sense to refer to and include any non water-soluble fragrant substance or mixture of substances including natural (i.e., obtained by extraction of flower, herb, blossom or plant), artificial (i.e., a mixture of natural oils or oil constituents) and synthetic (i.e., a single or mixture of synthetically produced substance) odoriferous substances. Typically perfumes are complex mixtures of blends of various organic compounds, such as, esters, ketones, hydrocarbons, lactones, alcohols, aldehydes, ethers, aromatic compounds and varying amounts of essential oils (e.g., terpenes) ranging from about 0% to about 80%, and usually from about 10% to 70% by weight, the essential oils themselves being volatile odoriferous compounds and also serve to dissolve the other components of the perfume. The precise composition of the perfume has no particular effect on fabric softening so long as it meets the criteria of water immiscibility and pleasant odor.

Organic solvents suitable for use in this invention include: aliphatic alcohols having 1 to about 6 carbon atoms, such as, ethanol, propanol, isopropanol, n-butanol, isobutanol, t-butanol, n-pentanol, isopentanol, sec-pentanol, n-hexanol, isohexanol, other isomers and the like; aliphatic polyalcohols, such as, ethylene glycol, propylene glycol, butylene glycol, diethylene glycol, dipropylene glycol, 1,4-butanediol, 2-methyl-pentanediol, hexane triol, tripropylene glycol, pentaerythritol, glycerol, sorbitol, and the like; aliphatic ethers, such as, ethylene glycol monobutyl ether(EGMBE), diethylene glycol monobutyl ether(DEGMBE), diethylene glycol dimethyl ether, triethylene dimethyl ether, ethylene glycol monomethyl ether, propylene glycol monoethyl ether, dipropylene glycol monomethyl ether, dipropylene glycolpropyl ether(DPnP), dipropylene glycolbutyl ether(DPnB), tripropylene glycol monomethyl ether, methoxy methyl butanol, and the like; aliphatic esters, such as, methyl lactate, ethyl lactate, isopropyl lactate, butyl lactate, dibasic esters of carboxylic acids, ethoxy ethyl acetate, and butoxy ethyl acetate.

Suitable fabric co-softeners include such fatty acids as lauric acid, palmitic acid, soft-tallow acid, oleic acid, and the like; such fatty alcohols as lauryl alcohol, palmityl alcohol, soft-tallowyl alcohol, oleyl alcohol, and the like; such fatty esters as glycerol mono oleate, glycerol di oleate, pentaerythritol mono oleate, sorbitan oleate, sucrose oleate, as well as these fatty esters where the oleate moiety is replaced by coconut, lauryl or palmityl moieties, and the like; such fatty amines as di-(ethyl-lauryl)-2-hydroxyethyl amine, di-(ethyl-soft tallow)-2-hydroxyethyl amine, and the like; and such amidoamines as di-coconut-amido-ethyl-2-hydroxyethyl amine, di-lauryl-amido-ethyl-2-hydroxyethylamine, di-soft tallow-amido-ethyl-2-hydroxyethylamine and the like.

The clear microemulsions of this invention have a particle size between about 10 and about 100 nanometers. They also permit formulation of fabric softeners in a concentrated form amounting to about 10% to about 60% by weight of the total composition. These microemulsions are shelf stable remaining as such for at least six weeks. After dilution with water, either to obtain a water dispersion of about 4 to about 6% in a bottle or to obtain a rinse liquor containing about 0.2 g. of active softener per liter in the washing machine, these microemulsions are converted to milky macroemulsions having a particle size of about 0.1 to about 100 micrometers in which form the softeners readily effect softening of the washed articles. The step of conversion from microemulsion to macroemulsion is achieved without gelification.

No special equipment is required to combine the components of these microemulsions. Mixing equipment known to those skilled in the art suffices.

It will be also understood by those skilled in this art that the above-described composition may additionally contain as optional components such materials as dyes, foam controllers, thickeners and the like.

The invention is further described in the examples which follow. All parts and percentages are by weight unless otherwise specified.

EXAMPLE. 1.

Preparation of Softener with a Dioleyl Diester Quaternary

A microemulsion was prepared by mixing 48.03 parts of water, 21.2 parts of hexyleneglycol, 2.5 parts of Dobanol 91-8 (trade name for a nonionic surfactant alkanol having 9 to 11 carbon atoms and 8 ethoxyl groups from Shell Chemical Co.), 1.27 parts of an oil containing perfume and methylbis-[ethyl(oleyl)]-2-hydroxyethyl ammonium methyl sulfate represented by the formula:

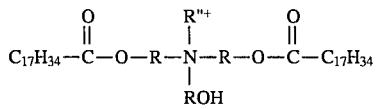

-continued $R''SO_4^-$ wherein R=—$C_2H_4$—and R"=—$CH_3$.

The mixing operation was carried out in a beaker equipped with an electric mixer and a 4-blade impeller. A water clear microemulsion was obtained which remained stable for at least six weeks and which turned into a milky macroemulsion upon dilution with water. A dilution of about 1 part microemulsion to 1000 parts water suffices.

Example 2 is a repetition of Example 1 with the exception that no oil containing perfume was charged to the mixer. In this combination the microemulsion dephased and did not afford a stable microemulsion.

EXAMPLES 3–6

Influence of Organic Solvent

The procedure described in Example 1 was repeated with varying amounts of the organic solvent component. The relevant data are presented in Table 1 below with physical observations of the resultant products.

TABLE 1

| | Example 3 | Example 4 | Example 5 | Example 6 |
|---|---|---|---|---|
| Water | 57.5 | 57.5 | 57.5 | 57.5 |
| Hexyleneglycol | 20 | | | |
| Ethylene Glycol MonoButyl Ether (EGMBE) | | 20 | | |
| Isopropyl lactate | | | 20 | |
| Butanol | | | | 20 |
| Dioleyl Diester Quat | 22.5 | 22.5 | 22.5 | 22.5 |
| Aspect of composition | Clear | Clear | Clear | Clear |
| Aspect after dilution | Turbid Emulsion | Clear | Turbid Emulsion | Turbid Emulsion |
| Stability | Stable 6W | Stable 6W | Slight Dephasing | Stable 6W |

The table above shows the influence of the organic solvent in a composition containing only Dioleyl Diester Quat and water. These data demonstrate the selection of suitable solvents for the preparation of microemulsions of particular combinations of softener and solvent. Here it is demonstrated that hexylene glycol and butanol are preferred solvents. EGMBE (Example 4) upon dilution with water leads to a clear solution instead of the desired result, viz., a macroemulsion which is necessary for softening fabrics. Isopropyl lactate is an unsatisfactory solvent in this system since it causes dephasing upon aging even though it provides a clear microemulsion and a turbid macroemulsion.

EXAMPLES 7–10

Effects of Other organic Solvents

The effects of using a lower glycol, an ether alkanol, a higher alkyl lactate and an alkanol with Dioleyl Diester Quat to form a microemulsion were studied. The pertinent data shown in Table 2 below indicate that these combinations have limitations here.

TABLE 2

| | Example 7 | Example 8 | Example 9 | Example 10 |
|---|---|---|---|---|
| Water | 57.5 | 57.5 | 57.5 | 57.5 |
| Ethyleneglycol | 20 | | | |

TABLE 2-continued

| | Example 7 | Example 8 | Example 9 | Example 10 |
|---|---|---|---|---|
| Methylmethoxy-butanol | | 20 | | |
| Butyl lactate | | | 20 | |
| Ethanol | | | | 20 |
| Dioleyl Diester Quat | 22.5 | 22.5 | 22.5 | 22.5 |
| Aspect of composition | Dephasing | Turbid | Dephasing | Clear Gel |
| Aspect after dilution | Turbid Emulsion | Turbid Emulsion | Turbid Emulsion | Turbid Emulsion |
| Stability | Dephasing | Clear Gel | Dephasing | Clear Gel |

Certain generalizations may be inferred from a comparison within solvent classes as to which solvents used in the preceding Examples give stable clear microemulsions and which give unstable products with Dioleyl Diester Quat. These are presented in TABLE 3 below. In addition stability also depends on the levels of solvent and Dioleyl Diester Quat used in the examples.

TABLE 3

| Solvent Class | Stable Clear Microemulsion | Unstable Microemulsion |
|---|---|---|
| Glycols | Hexylene glycol | Ethylene glycol |
| Ethers | EGMBE | Methylmethoxybutanol |
| Esters | Isopropyl lactate | Butyl lactate |
| Alkanols | Ethanol, butanol | |

EXAMPLES 11–13

Effects of Co-Surfactant

The preparation of microemulsions was attempted using the procedure of Example 1 with the addition of a co-surfactant, viz., oleyl alcohol. The results are correlated in TABLE 4 below.

TABLE 4

| | Example 11 | Example 12 | Example 13 |
|---|---|---|---|
| Water | 55 | 55 | 55 |
| Hexyleneglycol | 20 | | |
| ethyleneglycol Mono-Butyl Ether(EGMBE) | | 20 | |
| Isopropyl lactate | | | 20 |
| Oleyl Alcohol | 2.5 | 2.5 | 2.5 |
| Dioleyl Diester Quat | 22.5 | 22.5 | 22.5 |
| Aspect of composition | Clear Gel | Clear | Clear |
| Aspect after dilution | Turbid Emulsion | Clear | Turbid Emulsion |
| Stability | Clear Gel | Stable 6W | Stable 6W |

As can be seen from the results above, the addition of the co-surfactant, oleyl alcohol, modifies the selection of solvents used above for generating a clear microemulsion. Thus hexylene glycol leads to a clear gel not a microemulsion. Isopropyl lactate is the best of the three while EGMBE is rejected as in Example 4 for not affording a milky macroemulsion upon dilution. In a further extension of this invention, it was found that hexylene glycol can be adapted in Example 11 to provide a clear microemulsion by the addition of 0.1 part of nitrilo tri-methylene phosphonic acid available from Protex Co. as Masquol P320 and having the structure:

$N{\equiv}(CH_2PO_3H_2)_3$

Example 12 demonstrates the necessity for having a turbid macroemulsion after dilution with water inasmuch as it demonstrated poor fabric softening. Softening efficacy of these compositions was measured through evaluation versus known softening control substances. The evaluation procedure was carried out in paired comparison tests among six judges. Fabrics treated with test substances are compared against the control substances by their presentation to judges. The judges are asked to score the softness difference between the respective samples on a scale from 0 (no difference) to 3 (very high difference). For example, the microemulsion of Example 1 at a liquor concentration of 0.2375 g/L (45%) was found to be the equivalent of a reference known softening agent consisting of a dispersion of 0.2 g/L (4.5%) of distearyl dimethyl ammonium chloride by this evaluation technique.

EXAMPLES 14–17

Addition of Co-softening Agents

Co-softening agents were evaluated in the instant inventive compositions. The amounts of ingredients and physical results are presented in TABLE 5 below.

TABLE 5

| | Example 14 | Example 15 | Example 16 | Example 17 |
|---|---|---|---|---|
| Water | 56.6 | 56.6 | 56.6 | 56.6 |
| Isopropyl Alcohol | 25 | 25 | 25 | 25 |
| Glycerol MonoOleate | 3.4 | | | |
| Sorbitan TriOleate | | 3.4 | | |
| Polyethylene Glycol-600 - MonoOleate | | | 3.4 | |
| Sucrose Cocoate | | | | 3.4 |
| Dioleyl Diester Quat | 15 | 15 | 15 | 15 |
| Aspect of composition | Clear | Turbid | Clear | Clear |
| Aspect after dilution | Turbid Emulsion | Turbid Emulsion | Turbid Emulsion | Turbid Emulsion |
| Stability | Stable 6W | Dephasing | Stable 6W | Stable 6W |

Examples 14 to 17 relate to the addition of co-softening ingredients to the primary softener, DiOleyl Diester Quat. The structure of Glycerol MonoOleate is self evident from the name, where one hydroxyl group of glycerol was esterified with one mole of oleic acid. Polyethylene Glycol 600-MonoOleate is a polyethylene glycol having an approximate molecular weight of 600 esterified with one mole of oleic acid. The structure of Sucrose cocoate is given below:

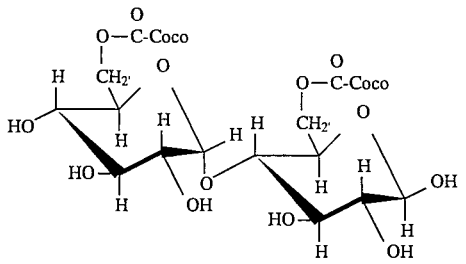

Sorbitan triOleate is a product obtained by esterifing one mole of sorbitol with three moles of oleic acid. All of these co-softeners are liquid at room temperature and contain olefinically unsaturated aliphatic chains. The selected solvent here is isopropyl alcohol and the level of the Dioleyl Diester Quat is reduced taking advantage of the fact that the inclusion of the co-softeners provides a synergistic softening and emulsifying effect. Glycerol monoOleate, Polyethylene Glycol-600 monoOleate, and sucrose cocoate afford stable microemulsions.

EXAMPLES 18–21

Emulsification of DiOleyl DiAmido Amine

A DiOleyl DiAmido Amine having the structure:

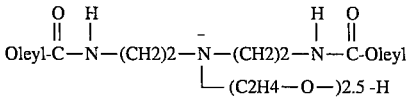

was emulsified to a microemulsion after conversion to a salt using the procedure of Example 1. The salt was prepared by neutralization of the free amine with Hydrochloric acid (25%), maleic acid, or lactic respectively. The ingredients used and the physical results are given in TABLE 6 below.

TABLE 6

| | Example 18 | Example 19 | Example 20 | Example 21 |
|---|---|---|---|---|
| Water | 58.75 | 57.45 | 57.59 | 57.85 |
| HexyleneGlycol | 20 | 20 | 20 | 20 |
| Hydrochloric Acid (25%) | | 1.3 | | |
| Maleic Acid | | | 1.16 | |
| Lactic Acid | | | | 0.9 |
| Dioleyl Diamido-Amine | 21.25 | 21.25 | 21.25 | 21.25 |
| Aspect of composition | Dephasing | Clear Gel | Clear | Gel |
| Aspect after dilution | Dephasing | Turbid Emulsion | Turbid Emulsion | Turbid Emulsion |
| Stability | Dephasing | Clear Gel | Stable 6W | Dephasing |

The neutralizing acid determined whether or not microemulsification took place. Maleic acid gave satisfactory results here while hydrochloric acid and lactic acid did not. When the amine was not neutralized (Example 18) no emulsification at all took place.

EXAMPLES 22–24

Solvent Effect

The role of the solvent was demonstrated in a study of the microemulsification of the Dioleyl Diamidoamine/maleic acid system. Pertinent data are presented in TABLE 7 together with the data from previously shown Example 20,

TABLE 7

| | Example 20 | Example 22 | Example 23 | Example 24 |
|---|---|---|---|---|
| Water | 57.59 | 57.59 | 57.59 | 57.59 |
| HexyleneGlycol | 20 | | | |
| Tert-Butanol | | 20 | | |
| EGMBE | | | 20 | |
| DEGMBE | | | | 20 |
| Maleic Acid | 1.16 | 1.16 | 1.16 | 1.16 |
| Dioleyl Diamido-Amine | 21.25 | 21.25 | 21.25 | 21.25 |
| Aspect of composition | Clear | Dephasing | Dephasing | Clear |
| Aspect after dilution | Turbid Emulsion | Dephasing | Dephasing | Turbid Emulsion |
| Stability | Stable 6W | Dephasing | Dephasing | Clear |

Hexylene glycol and DEGMBE can be seen from the above data to be preferred solvents for this system regarding the formation and stability of a microemulsion, Tert-butanol and EGMBE do not stabilize the emulsion which dephases,

EXAMPLES 25–28

Stabilization of Synergistic Mixture

Examples relate to the stabilization of the synergistic mixture of DiOleylDiester Quat and DiOleylDiAmidoAmine. The materials investigated are presented in TABLE 8 below,

TABLE 8

| | Example 25 | Example 26 | Example 27 | Example 28 |
|---|---|---|---|---|
| Water | 57.65 | 57.65 | 55.15 | 55.15 |
| HexyleneGlycol | 20 | | 20 | |
| Butanol | | 20 | | 20 |
| Dobanol 91-8 | | | 2.5 | 2.5 |
| Maleic Acid | 0.75 | 0.75 | 0.75 | 0.75 |
| Dioleyl Diamido-Amine | 13.6 | 13.6 | 13.6 | 13.6 |
| Dioleyl Diester Quat | 8 | 8 | 8 | 8 |
| Aspect of composition | Clear Gel | Clear | Dephasing | Dephasing |
| Aspect after dilution | Turbid Emulsion | Turbid Emulsion | Dephasing | Dephasing |
| Stability | Clear Gel | Clear | Dephasing | Dephasing |

In the series represented in Examples 25–28, n-butanol is the preferred solvent. A gel rather than a clear microemulsion was obtained with hexyleneglycol although the desired effect is obtained with the addition of 0.1 parts of Masquol P320. The addition of Dobanol 91-8 emulsifier did not help to avoid the formation of gels here but rather led to dephasing.

EXAMPLES 29–32

Use of DiOleyl Diester Quat Softener

Examples 29–32 relate to the use of DiOleyl Diester Quat with n-butanol as a solvent at several concentration levels. The data obtained are displayed in TABLE 9 below.

TABLE 9

| | Example 29 | Example 30 | Example 31 | Example 32 |
|---|---|---|---|---|
| Water | 46 | 65.5 | 57.5 | 76.5 |
| Butanol | 18 | 12 | 20 | 10 |
| Dioleyl Diester Quat | 36 | 22.5 | 22.5 | 13.5 |
| Aspect of composition | Clear | Clear Gel | Clear | Clear |
| Aspect after dilution | Turbid Emulsion | Turbid Emulsion | Turbid Emulsion | Turbid Emulsion |
| Stability | Stable 6W | Clear Gel | Stable 6W | Stable 6W |

These data demonstrate that microemulsions in the range of about 10% to about 35% were obtainable with n-butanol and that the level of solvent required to produce a microemulsion is not proportional to the level of active ingredient, but surprisingly, the ratio of solvent to dioleyl diester quat decreases when the level of active ingredient increases. In Example 32 the ratio is 0.74. In Example 29 the ration is 0.51.

Although the invention has been described with a certain amount of particularity, it is understood that the present disclosure of the preferred forms has been made only by way of example and that numerous changes and modifications can be made without departing from the spirit and scope of the invention.

What is claimed is:

1. A clear fabric softener aqueous microemulsion concentrate composition, having a particle size between about 10 and about 100 nanometers, capable of conversion to a milky macroemulsion upon dilution with water consisting essentially of:

(A) about 10% to about 60% by weight of a diester quaternary ammonium surfactant fabric softener having the formula:

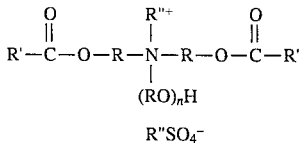

(1)

wherein R is an alkylene radical having 2 to about 4 carbon atoms,

R' is an alkyl or alkenyl group having 8 to about 22 carbon atoms, n is an integer having values of 1 to about 4, and R" is a lower alkyl radical having 1 to about 4 carbon atoms, and/or about 10% to about 60% of a diamido ammonium surfactant fabric softener having the formula:

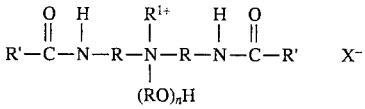

(2)

wherein n, R and R' are as defined above, $R^{1+}$ is a lower alkyl radical having 1 to about 4 carbon atoms or hydrogen and X is $R''SO_4^-$, $Br^-$ or $Cl^-$ wherein R" is a lower alkyl radical having 1 to about 4 carbon atoms, (B) about 5% to about 40% by weight of an organic solvent, (C) up to about 10% of an optional water-immiscible oil perfume, and (D) up to about 15% by weight of an optional fabric co-softener selected from the group consisting of fatty alcohols, fatty acids, fatty esters, fatty amines or amidoamines, and (E) sufficient water to bring the total aqueous microemulsion concentrate composition to 100% by weight.

2. Composition claimed in claim 1 wherein the fabric softener (A) is a diester quaternary ammonium surfactant.

3. Composition claimed in claim 2 wherein the diester quaternary ammonium surfactant is methyl bis[ethyl(oleyl)]-2-hydroxyethyl ammonium methyl sulfate.

4. Composition claimed in claim 1 wherein the fabric softener is a combination of a diester quaternary ammonium surfactant and a diamido ammonium surfactant.

5. Composition claimed in claim 4 wherein the diamido ammonium surfactant is methyl bis-(oleyl amido ethyl)-2-hydroxyethyl ammonium methyl sulfate.

6. Composition claimed in claim 4 wherein the diamido ammonium surfactant is a salt of a dioleyl diamido amine.

7. Composition claimed in claim 1 wherein the fabric softener is a diamido ammonium surfactant.

8. Composition claimed in claim 7 wherein the diamido ammonium surfactant is methyl bis-(oleyl amido ethyl)-2-hydroxyethyl ammonium methyl sulfate.

9. Composition claimed in claim 7 wherein the diamido ammonium surfactant is a salt of a dioleyl diamino amine.

10. Composition claimed in claim 9 wherein the salt is a salt of maleic acid.

11. Composition claimed in claim 1 wherein said composition contains about 270 of a water-immiscible oil-perfume.

12. Composition claimed in claim 1 wherein the organic solvent is a lower alkanol.

13. Composition claimed in claim 12 wherein the alkanol is isopropyl alcohol.

14. Composition claimed in claim 12 wherein the alkanol is a butanol.

15. Composition claimed in claim 1 wherein the organic solvent is a glycol.

16. Composition claimed in claim 15 wherein the glycol is hexylene glycol.

17. Composition claimed in claim 1 wherein the organic solvent is an aliphatic ether.

18. Composition claimed in claim 17 wherein the aliphatic ether is ethylene or diethylene glycol monobutyl ether.

19. Composition claimed in claim 17 wherein the aliphatic ether is dipropylene glycol methyl ether.

20. Composition claimed in claim 17 wherein the aliphatic ether is dipropylene glycol butyl ether.

21. Composition claimed in claim 1 wherein the fabric co-softener is a fatty alcohol.

22. Composition claimed in claim 21 wherein the fatty alcohol is oleyl alcohol.

23. Composition claimed in claim 1 wherein the fabric softener is a fatty ester.

24. Composition claimed in claim 23 wherein the fatty ester is glycerol monooleate.

25. Composition claimed in claim 23 wherein the fatty ester is a polyethylene glycol monooleate.

26. Composition claimed in claim 23 wherein the fatty ester is sucrose cocoate.

* * * * *